US010920514B2

(12) United States Patent
Geoffroy

(10) Patent No.: US 10,920,514 B2
(45) Date of Patent: Feb. 16, 2021

(54) HYDRAULIC PACKER SETTING TOOL WITH ANTI-PRESET FEATURE

(71) Applicant: Halliburton Energy Services, Inc., Houston, TX (US)

(72) Inventor: Gary John Geoffroy, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 4 days.

(21) Appl. No.: 16/330,332

(22) PCT Filed: Sep. 14, 2016

(86) PCT No.: PCT/US2016/051649
§ 371 (c)(1),
(2) Date: Mar. 4, 2019

(87) PCT Pub. No.: WO2018/052410
PCT Pub. Date: Mar. 22, 2018

(65) Prior Publication Data

US 2019/0203550 A1 Jul. 4, 2019

(51) Int. Cl.
*E21B 23/06* (2006.01)
*E21B 33/12* (2006.01)
*E21B 33/128* (2006.01)

(52) U.S. Cl.
CPC ..... *E21B 23/06* (2013.01); *E21B 33/12* (2013.01); *E21B 33/1285* (2013.01)

(58) Field of Classification Search
CPC combination set(s) only.
See application file for complete search history.

(56) References Cited

U.S. PATENT DOCUMENTS 3,519,075 A * 7/1970 Mullins ..... E21B 34/125 166/150
3,948,322 A * 4/1976 Baker ..... E21B 33/16 166/289
5,375,662 A 12/1994 Echols, III et al.
5,404,955 A 4/1995 Echols, III et al.
5,413,180 A 5/1995 Ross et al.
(Continued)

OTHER PUBLICATIONS

International Search Report and Written Opinion dated May 31, 2017 in International Application No. PCT/US2016/051649.

*Primary Examiner* — Cathleen R Hutchins
*Assistant Examiner* — Ronald R Runyan
(74) *Attorney, Agent, or Firm* — McGuire Woods, LLP

(57) ABSTRACT

A completion running tool includes a body that defines a central flow passage and one or more radial flow ports. A piston is coupled to the body at a releasable coupling and positioned for longitudinal movement within a piston chamber defined radially between the body and an outer shroud. A prop sleeve is positioned in the central passage and defines one or more apertures that facilitate fluid communication between the central passage and a piston setting chamber via the one or more radial flow ports. The prop sleeve is movable within the central flow passage between a first position, where the prop sleeve radially supports the releasable coupling and thereby prevents disengagement of the piston, and a second position, where the piston is able to disengage from the releasable coupling and move within the piston chamber.

18 Claims, 7 Drawing Sheets

(56) References Cited

U.S. PATENT DOCUMENTS

| | | | | | |
|---|---|---|---|---|---|
| 5,826,652 | A | * | 10/1998 | Tapp | E21B 23/06 166/120 |
| 5,954,133 | A | * | 9/1999 | Ross | E21B 17/07 166/297 |
| 6,364,017 | B1 | | 4/2002 | Stout et al. | |
| 6,736,214 | B2 | | 5/2004 | Hoffman et al. | |
| 8,534,368 | B2 | | 9/2013 | Reimert et al. | |
| 2015/0308206 | A1 | | 10/2015 | Yue et al. | |

* cited by examiner

HYDRAULIC PACKER SETTING TOOL WITH ANTI-PRESET FEATURE

BACKGROUND

In the course of completing an oil and/or gas well, it is common practice to convey a lower completion assembly into a wellbore on a work string. The lower completion assembly often includes one or more sand screens and at least one wellbore packer that is set to divide the wellbore into various completion intervals. While conveying the lower completion assembly downhole, a fluid (e.g., brine, drilling fluid, a completion fluid, etc.) is sometimes pumped through the work string and a coupled wash pipe to a float shoe coupled to the end of the lower completion assembly. The fluid exits the float shoe and washes any debris that may have been inadvertently left in the wellbore, thereby allowing the lower completion assembly to reach a desired depth. Once the lower completion assembly reaches its target depth, the packer(s) is customarily set and sand control operations are performed within the annulus in the zone around the screens. Later, during the production phase, production fluids flow through the screen and the lower completion assembly into production tubing subsequently coupled to the lower completion assembly. The production fluids are then conveyed to the well surface for collection.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to completing wells in the oil and gas industry and, more particularly, to a completion running tool including an anti-preset feature that helps prevent premature setting of a wellbore packer.

The embodiments disclosed herein describe a completion running tool for a downhole completion assembly. Prior completion assemblies have included an isolation sleeve that would be move to expose a piston setting chamber and an associated piston to hydraulic pressure. When in place, however, the isolation sleeve can generate an atmospheric trap in the piston setting chamber that can limit the ability to run the particular completion running tool into wellbores with high reservoir pressures. The completion running tools described herein do not fluidly isolate the piston setting chamber and, therefore, do not generate an atmospheric pressure trap. Rather, fluid circulating through the completion running tools of the present disclosure is free to access the piston setting chamber at any time during run-in and wellbore washing operations.

Figure 1:
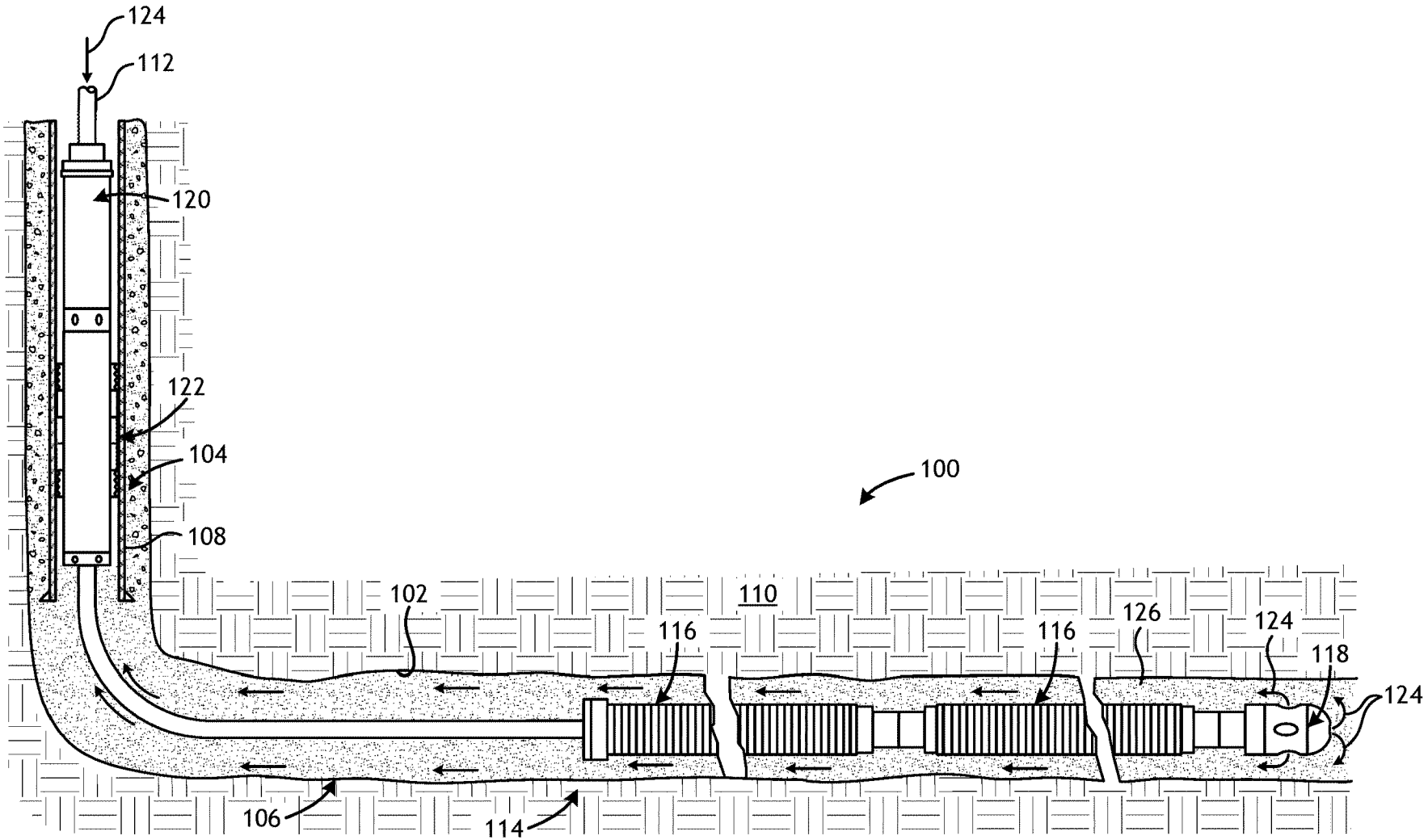
FIG. 1 is an example well system that may incorporate the principles of the present disclosure.

FIG. 1 is an example well system 100 that may incorporate the principles of the present disclosure. As depicted, the well system 100 includes a wellbore 102 drilled through various earth strata and having a substantially vertical section 104 that transitions into a substantially horizontal section 106. At least a portion of the vertical section 104 may have a string of casing 108 cemented therein to support the wellbore 102, and the horizontal section 106 may extend through one or more hydrocarbon bearing subterranean formations 110. In at least one embodiment, as illustrated, the horizontal section 106 may comprise an open hole section of the wellbore 102. In other embodiments, however, the casing 108 may also extend into the horizontal section 106, without departing from the scope of the disclosure.

A work string 112 comprising, for example, multiple lengths of drill pipe coupled end to end is extended into the wellbore 102 from a surface location (not shown), such as the Earth's surface. A lower completion assembly 114 is secured to the lower end of the work string 112 and is arranged within the horizontal section 106. As depicted, the lower completion assembly 114 may include a plurality of sand screens 116 (two shown) axially offset from each other along portions of the lower completion assembly 114. In operation, each sand screen 116 serves the primary function of filtering particulate matter out of the production fluid stream originating from the formation 110 such that particulates and other fines are not produced to the surface. The lower completion assembly 114 terminates at a float shoe 118.

The lower completion assembly 114 is coupled to the work string 112 by a completion running tool 120 and a wellbore packer 122. The wellbore packer 122 may comprise a variety of known designs and configurations to provide a sealed interface within the wellbore 102. In some embodiments, as illustrated, the wellbore packer 122 may include compressible seal elements and radially extendible anchor slips. In other embodiments, however, the wellbore packer 122 may comprise an inflatable bladder or the like. It will be appreciated, however, that either type of wellbore packer 122 may be employed, without departing from the scope of the disclosure.

As the lower completion assembly 114 is conveyed into the horizontal section 106, a fluid 124 (e.g., brine, drilling fluid, a completion fluid, etc.) may be pumped through the work string 112 and the lower completion assembly 114, where it is eventually discharged via the float shoe 118. The fluid 124 exits the float shoe 118 and circulates back toward the surface within the annulus 126 defined between the lower completion assembly 114 and the wall of the wellbore 102. As it circulates back uphole, the fluid 124 washes the wellbore 102 by circulating drill cuttings, filter cake, debris, and lost circulation materials from the annulus 126 upwardly for recovery at the surface, as indicated by the arrows.

While the wash and circulation operation progresses, the wellbore packer 122 is in its radially contracted condition, as shown in FIG. 1. In some applications, the wellbore packer 122 may become exposed to high pressure hydraulic fluctuations if there is a large amount of debris in the annulus 126 which must be displaced. As a result, the wellbore packer 122 may be inadvertently set and seized against the uncased wellbore 102 (or against casing in a cased hole application). According to embodiments of the present disclosure, however, and as is described in greater detail below, inadvertent setting of the wellbore packer 122 may be prevented using an anti-preset feature included in the completion running tool 120.

It should be noted that even though FIG. 1 depicts the lower completion assembly 114 as being arranged in an open hole portion of the wellbore 102, embodiments are contemplated herein where depicts the lower completion assembly 114 is arranged within cased portions of the wellbore 102. Moreover, while FIG. 1 depicts the lower completion assembly 114 as being arranged in a generally horizontal section 106 of the wellbore 102, the lower completion assembly 114 is equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
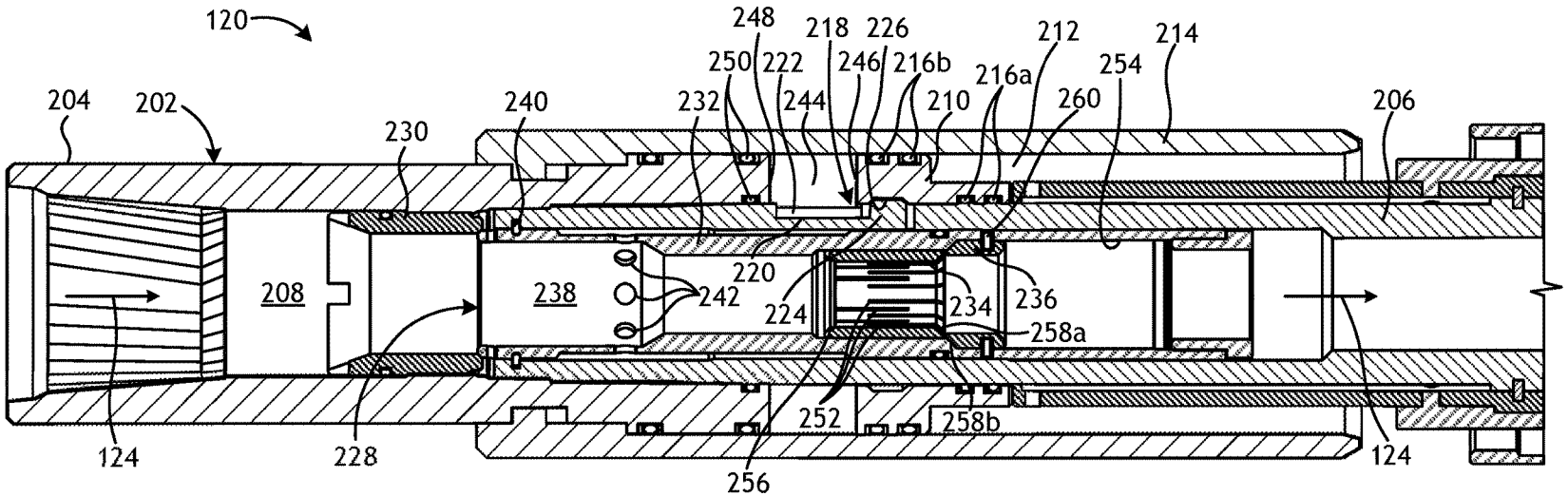
FIGS. 2A-2E are cross-sectional views of an example embodiment of the completion running tool of FIG. 1.

FIGS. 2A through 2E are cross-sectional views of an example embodiment of the completion running tool 120. Among other operations, the completion running tool 120 may be configured to help actuate and set the wellbore packer 122 (FIG. 1) at a desired time and location within the wellbore 102 (FIG. 1). As illustrated in FIG. 2A, the completion running tool 120 may include an elongate, tubular body 202 that includes an outer mandrel 204 coupled to an inner mandrel 206. In some embodiments, the inner mandrel 206 may be mechanically fastened (e.g., threaded, bolted, welded, etc.) to the outer mandrel 204, but the outer and inner mandrels 204, 206 may alternatively comprise a monolithic component. The distal or downhole end of the inner mandrel 206 (i.e., to the right in FIG. 2A) may be removably coupled to the wellbore packer 122 such that the completion running tool 120 may be separated from the wellbore packer 122 once the wellbore packer 122 is set.

The outer and inner mandrels 204, 206 (collectively the body 202) may define a central flow passage 208, and the outer mandrel 204 may be configured to be coupled to the work string 112 (FIG. 1). Accordingly, once the outer mandrel 204 is appropriately connected to the work string 112, the central flow passage 208 will be placed in fluid communication with the work string 112 such that fluids and objects conveyed through the work string 112 will be introduced into the central flow passage 208 of the completion running tool 120.

The completion running tool 120 further includes a piston 210 positioned for longitudinal movement within a piston chamber 212 defined radially between the inner mandrel 206 and an outer shroud 214 coupled to the exterior of the body 202. In some embodiments, as illustrated, the outer shroud 214 may be coupled to the outer mandrel 204 and extend longitudinally therefrom. The piston 210 is sealed against leakage of pressurized fluid by one or more inner seal elements 216*a* and one or more outer seal elements 216*b*. The inner seal elements 216*a* sealingly engage the outer surface of the body 202 (i.e., the inner mandrel 206) and the outer seal elements 216*b* sealingly engage the inner radial surface of the outer shroud 214.

The inner and outer seal elements 216*a,b* may comprise a variety of sealing devices that, in some embodiments, operate as dynamic seals. As used herein, the term "dynamic seal" refers to a seal that provides pressure and/or fluid isolation between members that have relative displacement therebetween, for example, a seal that seals against a displacing surface, or a seal carried on one member and sealing against the other member while both members are stationary or one member is moving with respect to the other. As described herein, the piston 210 may be configured to translate axially within the piston chamber 212 and the inner and outer seal elements 216*a,b* may be configured to "dynamically" seal against the outer surface of the body 202 (i.e., the inner mandrel 206) and the inner surface of the outer shroud 214 as the piston 210 moves.

The inner and outer seal elements 216*a,b* may be made of a variety of materials including, but not limited to, an elastomeric material, a rubber, a metal, a composite, a ceramic, any derivative thereof, and any combination thereof. In some embodiments, as illustrated, the inner and outer seal elements 216*a,b* may comprise O-rings or the like. In other embodiments, however, the inner and outer seal elements 216*a,b* may comprise a set of v-rings or CHEVRON® packing rings, or another appropriate seal configuration (e.g., seals that are round, v-shaped, u-shaped, square, oval, t-shaped, etc.), as generally known to those skilled in the art. One or more of the inner and outer seal elements 216*a,b* may alternatively comprise a molded rubber or elastomeric seal, a metal-to-metal seal (e.g., O-ring, crush ring, crevice ring, up stop piston type, down stop piston type, etc.), or any combination of the foregoing.

The piston 210 may be coupled to the body 202 (i.e., the inner mandrel 206) at a releasable coupling 218. In the illustrated embodiment, the releasable coupling 218 comprises a collet having one or more collet fingers 220 (one shown) provided by the inner mandrel 206 and separated by longitudinal slots 222 (one shown) defined through the inner mandrel 206. Each collet finger 220 may include a head 224 configured to engage a piston profile 226 provided by the piston 210. In some embodiments, the piston profile 226 may comprise a recessed portion defined on the inner radial surface of the piston 210. In other embodiments, however, the piston profile 226 may comprise a threaded profile configured to threadably engage a corresponding threaded profile provided on the head 224. In yet other embodiments, the piston profile 226 may comprise a series of angled teeth configured to mate with a corresponding series of opposing angled teeth defined on the head 224.

The completion running tool 120 may further include an expendable seat assembly 228 arranged within the central flow passage 208 of the body 202. The seat assembly 228 may be secured within the flow passage 208 axially adjacent a mounting collar 230 arranged within the outer mandrel 204. The mounting collar 230 may help properly situate the seat assembly 228 within the central flow passage 208. As illustrated, the seat assembly 228 may include a prop sleeve 232, an expandable ring 234, and a shear collar 236.

The prop sleeve 232 provides a flow bore 238 that fluidly communicates with the central flow passage 208 such that fluids passing through the central flow passage 208 are likewise able to pass through the seat assembly 228 when a wellbore projectile is not received at the seat assembly 228, as discussed below. The prop sleeve 232 may be coupled to the body 202 (i.e., the inner mandrel 206) using one or more upper shear members 240, such as a shear pin, a shear screw, a shear ring, etc.

The prop sleeve 232 provides and otherwise defines one or more apertures 242 that facilitate fluid communication between the flow bore 238 (and the central flow passage 208) and a piston setting chamber 244 defined in the piston chamber 212. More specifically, the piston setting chamber 244 is defined axially between an uphole end 246 of the piston 210 and an opposing downhole end 248 of the body 202 (i.e., the outer mandrel 204). Inner and outer seal elements 250 provided on the opposing end 248 of the body 202 operate in conjunction with the inner and outer seal elements 216*a,b* of the piston 210 to provide a fluid tight seal at the axial ends of the piston setting chamber 244. Fluids passing through the apertures 242 may access the piston setting chamber 244 radially via the longitudinal slots 222 defined in the inner mandrel 206. Accordingly, the longitudinal slots 222 may be characterized and otherwise referred to herein as "radial flow ports."

Figure 2B:
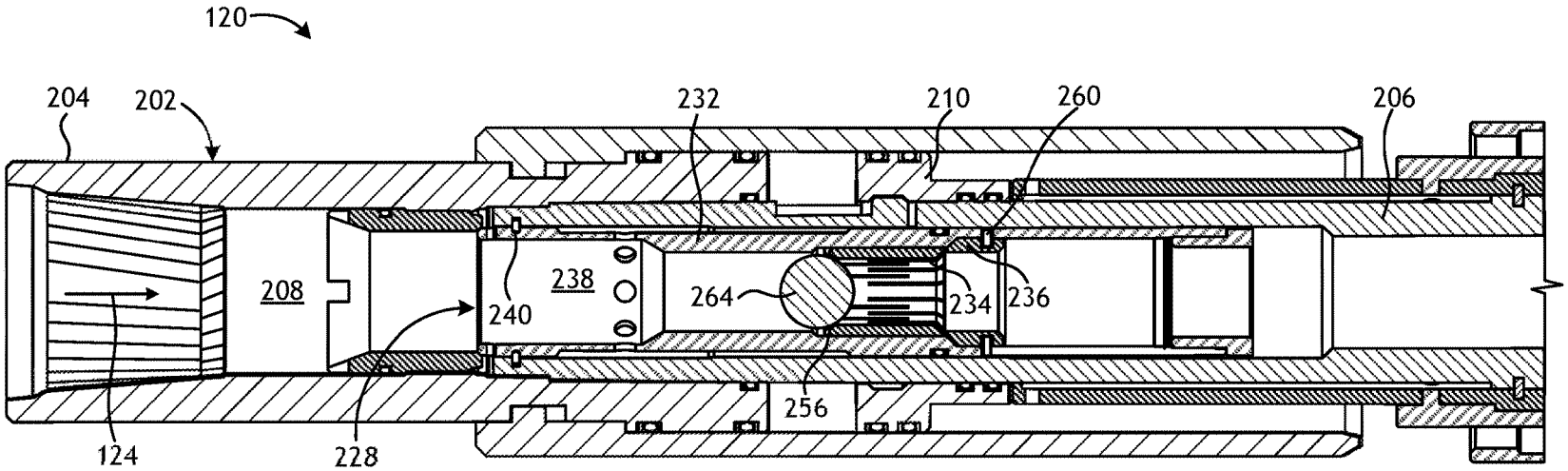
Figure 2C:
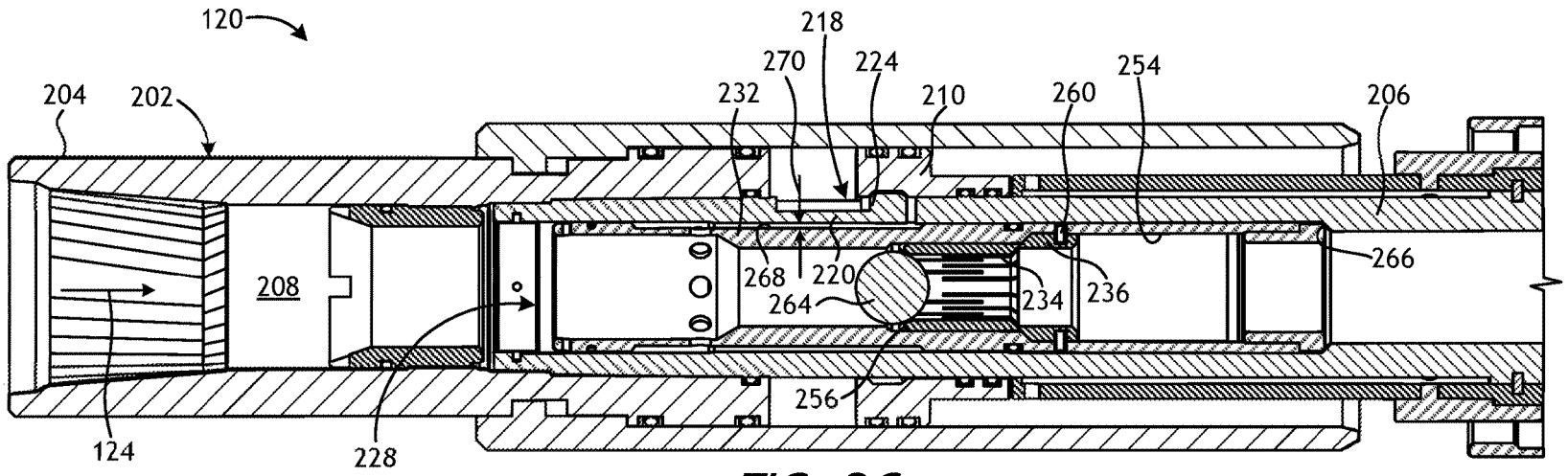
Figure 2D:
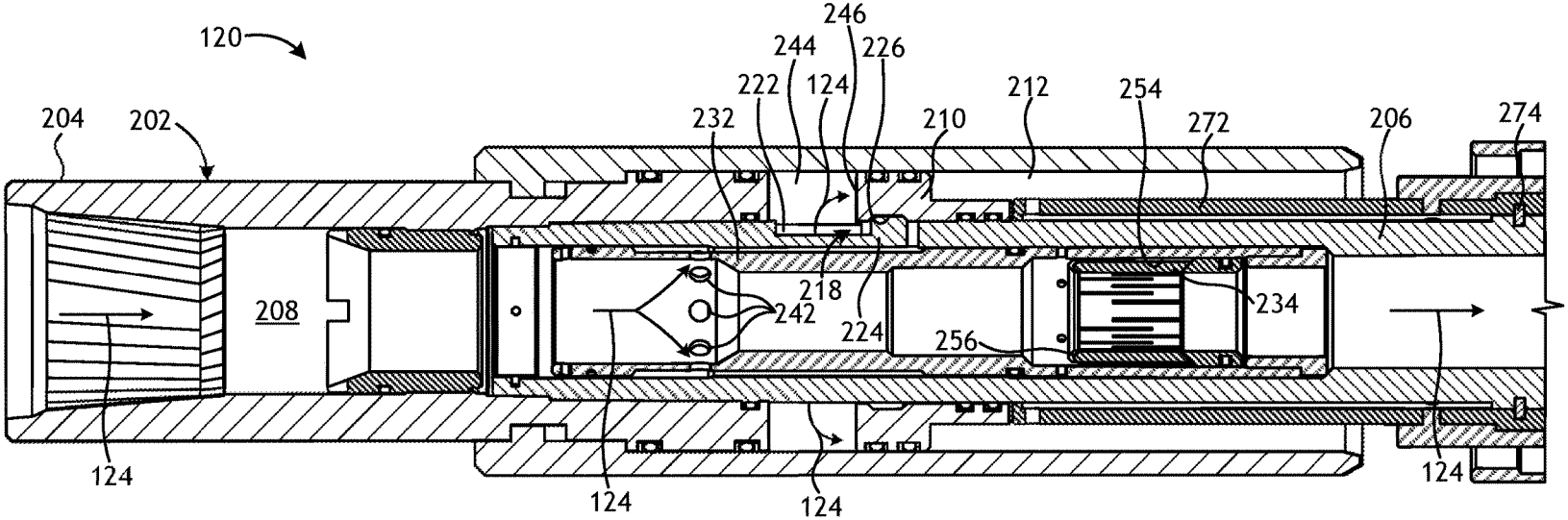
Figure 2E:
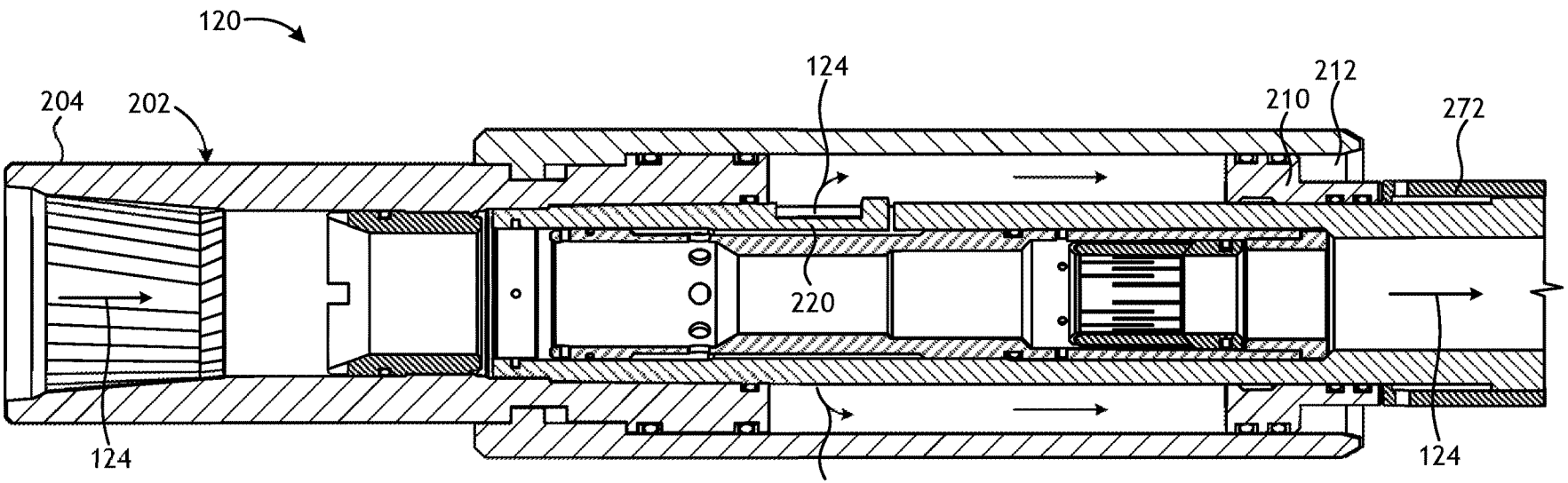

The prop sleeve 232 may be movable within the central flow passage 208 between a first position (shown in FIGS. 2A-2B) and a second position (shown in FIGS. 2C-2E). In the first position, the prop sleeve 232 radially supports the releasable coupling 218. More specific to the illustrated embodiment, the collet finger(s) 220 may be radially supported by the prop sleeve 232 in the first position, which maintains the head 224 in coupled engagement with the piston profile 226. Until the head 224 disengages from the piston profile 226, the piston 210 will be unable to axially translate within the piston chamber 212. Upon moving the prop sleeve 232 to the second position, however, the collet finger(s) 220 will no longer be radially supported by the prop sleeve 232, which allows the head 224 to disengage from the piston profile 226.

The expandable ring 234 (alternately referred to as a "C-ring") may be movable between a radially contracted condition and a radially expanded condition. As shown in FIG. 2A, the expandable ring 234 is in the radially contracted condition and is otherwise compressed within the flow bore 238 of the prop sleeve 232. The expandable ring 234 defines a plurality of longitudinal slots 252 that allows the expandable ring 234 to radially expand and contract. The expandable ring 234 is naturally biased to the radially expanded condition, but is maintained in the radially contracted condition while arranged within the flow bore 238. As described below, however, the expandable ring 234 may be allowed to radially expand upon being shifted axially within the flow bore 238 to an enlarged diameter counterbore 254 defined within the flow bore 238.

The uphole end of the expandable ring 234 may provide a wellbore projectile seat 256 configured to receive and seat a wellbore projectile, such as a ball or a plug. In some embodiments, the seat 256 may be coated with a polymeric coating, such as nitrile rubber, to form a receptacle for the wellbore projectile. The polymeric coating may prove advantageous in helping to facilitate a fluid tight seal within the central flow passage 208 upon receiving the wellbore projectile. The polymeric coating may also prove advantageous in helping maintain the expandable ring 234 in the radially contracted condition until it is desired to transition to the radially expanded condition.

The lower end of the expandable ring 234 has a beveled face 258*a* configured to mate with an opposing beveled face 258*b* of the shear collar 236. The shear collar 236 may be positioned within the counterbore 254 and coupled to the prop sleeve 232 with one or more lower shear members 260. Axial displacement of the expandable ring 234 in the downhole direction within the flow bore 238 is prevented by axial engagement with the shear collar 236 at the opposing beveled faces 258*a,b*. The lower shear member(s) 260 may be similar to the upper shear member(s) 240, except that the shear limit of the lower shear member(s) 260 may be greater than the shear limit of the upper shear member(s) 240.

Example operation of the completion running tool 120 is now provided with reference to FIGS. 2A-2E. In FIG. 2A, the completion running tool 120 is in a run-in configuration where the completion running tool 120 can be conveyed into the wellbore 102 (FIG. 1) as coupled to the work string 112 (FIG. 1) at the outer mandrel 204. While being conveyed downhole, the fluid 124 (e.g., brine, drilling fluid, a completion fluid, etc.) may be circulated through the work string 112 and into the central flow passage 208 of the completion running tool 120. The fluid 124 circulates through the completion running tool 120 and is eventually discharged into the wellbore 102 at the float shoe 118 (FIG. 1) coupled to the end of the lower completion assembly 114 (FIG. 1). The fluid 124 exits the float shoe 118 and circulates back toward the surface and, in the process, washes the wellbore 102 by removing drill cuttings, filter cake, debris, and lost circulation materials.

As the fluid 124 circulates through the completion running tool 120, the fluid 124 is able access the piston setting chamber 244 via the apertures 242 defined in the prop sleeve 232 and the radial flow ports 222 (i.e., the longitudinal slots 222 of the collet) defined in the inner mandrel 206. As a result, the fluid 124 is always able to communicate with the uphole end 246 of the piston 210. This may prove advantageous in precluding the existence of an atmospheric trap in the piston setting chamber 244, which has historically been the case with prior completion running tools. More specifically, some completion running tools fluidly isolate the piston setting chamber 244 using an isolation sleeve. The isolation sleeve creates an atmospheric pressure trap that can limit the ability to run the particular completion running tool into wellbores with high reservoir pressures since the large pressure differential may damage the tool and/or prevent it from working properly. The completion running tool 120 described herein, however, does not generate an atmospheric pressure trap in the piston setting chamber 244 since the fluid 124 is free to access the piston setting chamber 244 via the apertures 242 and the radial flow ports 222 at all times.

FIG. 2B shows a wellbore projectile 264 received within the completion running tool 120. When it is desired to set the wellbore packer 122 (FIG. 1), the wellbore projectile 264 may be conveyed to the completion running tool 120 via the work string 112 (FIG. 1). The wellbore projectile 264 is depicted in FIG. 2B as a ball, but could alternatively be a plug or a dart, without departing from the scope of the disclosure. The wellbore projectile 264 passes into the central flow passage 208 and the flow bore 238 until landing on and otherwise being received by the seat 256 provided on the uphole end of the expandable ring 234. The wellbore projectile 264 sealingly engages the seat 256 and thereby prevents the fluid 124 from bypassing the seat assembly 228 in the downhole direction.

With the wellbore projectile 264 sealingly engaged against the seat 256, increasing the pressure of the fluid 124 within the central flow passage 208 allows the prop sleeve 232 to disengage from the body 202 (i.e., the inner mandrel 206). More specifically, the hydraulic pressure of the fluid 124 acting on the wellbore projectile 264 is converted to an axial load placed on the seat assembly 228 and, more particularly, on the expandable ring 234 held in place by the shear collar 236. The axial load assumed on the expandable ring 234 is transferred to the shear collar 236, which transfers the axial load to the prop sleeve 232 via the lower shear member(s) 260. Accordingly, increasing the pressure of the fluid 124 results in an axial load being assumed by the upper shear member(s) 240 that couple the prop sleeve 232 to the body 202 (i.e., the inner mandrel 206). To release the prop sleeve 232, the pressure of the fluid 124 may be increased to a first pressure, which results in a predetermined axial load being exerted on the upper shear member(s) 240 at or above the shear limit of the upper shear member(s) 240. Consequently, upon assuming the predetermined axial load, the upper shear member(s) 240 fail and free the prop sleeve 232 from the inner mandrel 206. The hydraulic pressure acting on the seat assembly 228 may then urge the seat assembly 228 to move axially within the central flow passage 208 in the downhole direction (i.e., to the right in FIG. 2B) from the first position to the second position.

In FIG. 2C, the prop sleeve 232 is shown as having moved axially within the central flow passage 208 to the second position. In some embodiments, the seat assembly 228 may move in the downhole direction until the distal end of the prop sleeve 232 engages a radial shoulder 266 defined on the inner mandrel 206. With the prop sleeve 232 axially engaged against the radial shoulder 266, axial movement of the seat assembly 228 in the downhole direction is stopped. Moreover, with the prop sleeve 232 in the second position, radial support of the releasable coupling 218 is removed and, more particularly, the prop sleeve 232 has moved out of radial engagement with the collet fingers 220. The prop sleeve 232 may define a reduced diameter portion 268, which provides a gap 270 between the collet fingers 220 and the outer radial surface of the prop sleeve 232 when the prop sleeve 232 is in the second position. The gap 270 may provide an area for the collet fingers 220 to flex radially inward to allow the head 224 to disengage from the piston profile 226 when desired.

At this point, the wellbore projectile 264 may be released from the seat 256 by moving the expandable ring 234 into the counterbore 254 and thereby allowing the expandable ring 234 to radially expand. This may be accomplished by increasing the hydraulic pressure of the fluid 124 acting on the wellbore projectile 264, and thereby placing an increased axial load on the expandable ring 234 held in place by the shear collar 236. Increasing the pressure of the fluid 124 from the first pressure to a second pressure results in an increased axial load being exerted on the lower shear member(s) 260 that couple the prop sleeve 232 to the body 202 (i.e., the inner mandrel 206). More particularly, the second pressure may result in a predetermined axial load being exerted on the lower shear member(s) 260 at or above the shear limit of the lower shear member(s) 260. Consequently, upon assuming the predetermined axial load, the lower shear member(s) 260 fail and free the shear collar 236 from the prop sleeve 232. The hydraulic pressure acting on the wellbore projectile 264 may then urge the expandable ring 234 and the shear collar 236 to move in the downhole direction (i.e., to the right in FIG. 2C), which moves the expandable ring 234 into the counterbore 254 and allows the expandable ring 234 to radially expand and release the wellbore projectile 264.

In FIG. 2D, the expandable ring 234 is shown as having shifted downhole and into the counterbore 254. Once in the counterbore 254, the expandable ring 234 will be allowed to radially expand and release the wellbore projectile 264 (FIGS. 2B-2C) from the seat 256. The wellbore projectile 264 may then flow downhole and out of the completion running tool 120. In some embodiments, the fluid 124 may flow the wellbore projectile 264 downhole until locating and sealing against another downhole component, such as a ball catcher or another type of ball seat downhole from the completion running tool 120.

Upon sealing against the downhole component, hydraulic pressure within the central flow passage 208 may act on the piston 210 and thereby trigger actuation of the wellbore packer 122 (FIG. 1). More specifically, a packer setting arm 272 may be positioned axially adjacent the piston 210 and operatively coupled to the wellbore packer 122. Actuating or moving the piston 210 within the piston chamber 212 may engage and correspondingly move the packer setting arm 272 in the same direction, which results in the actuation of the wellbore packer 122. The piston 210 may be moved by hydraulic pressure of the fluid 124 entering the piston setting chamber 244 and acting on the uphole end 246 of the piston 210. As described above, the fluid 124 may access the piston setting chamber 244 via the apertures 242 defined in the prop sleeve 232 and the radial flow ports 222 defined in the body 202 (i.e., the inner mandrel 206).

The hydraulic pressure acting on the piston 210 may be configured to disengage the releasable coupling 218, and thereby free the piston 210 to axially translate within the piston chamber 212. More specifically, the hydraulic pressure places an axial load on the piston 210 that forces the collet finger(s) 220 to flex radially inward such that the head 224 disengages from the piston profile 226. In some embodiments, the packer setting arm 272 may be coupled to the body 202 (i.e., the inner mandrel 206) with one or more shear members 274. In such embodiments, the hydraulic pressure acting on the piston 210 must be sufficient to disengage the releasable coupling 218 and break (shear) the shear members 274 as the piston 210 is forced against the packer setting arm 272. In other embodiments, however, the shear members 274 may be omitted from the completion running tool 120, without departing from the scope of the disclosure.

In some embodiments, moving the piston 210 and the packer setting arm 272 to thereby actuate the wellbore packer 122 (FIG. 1) may require that the hydraulic pressure of the fluid 124 be increased to a third pressure that is greater than the second pressure. In other embodiments, however, the second pressure may be sufficient to move the expandable ring 234 and simultaneously move the piston 210 and the packer setting arm 272 to actuate the wellbore packer 122 (FIG. 1), without departing from the scope of the disclosure.

In FIG. 2E, the piston 210 is shown disengaged from the collet fingers 220 and moved downhole within the piston chamber 212. As the piston 210 moves, the packer setting arm 272 correspondingly moves in the same direction to actuate the wellbore packer 122 (FIG. 1).

Figure 3A:
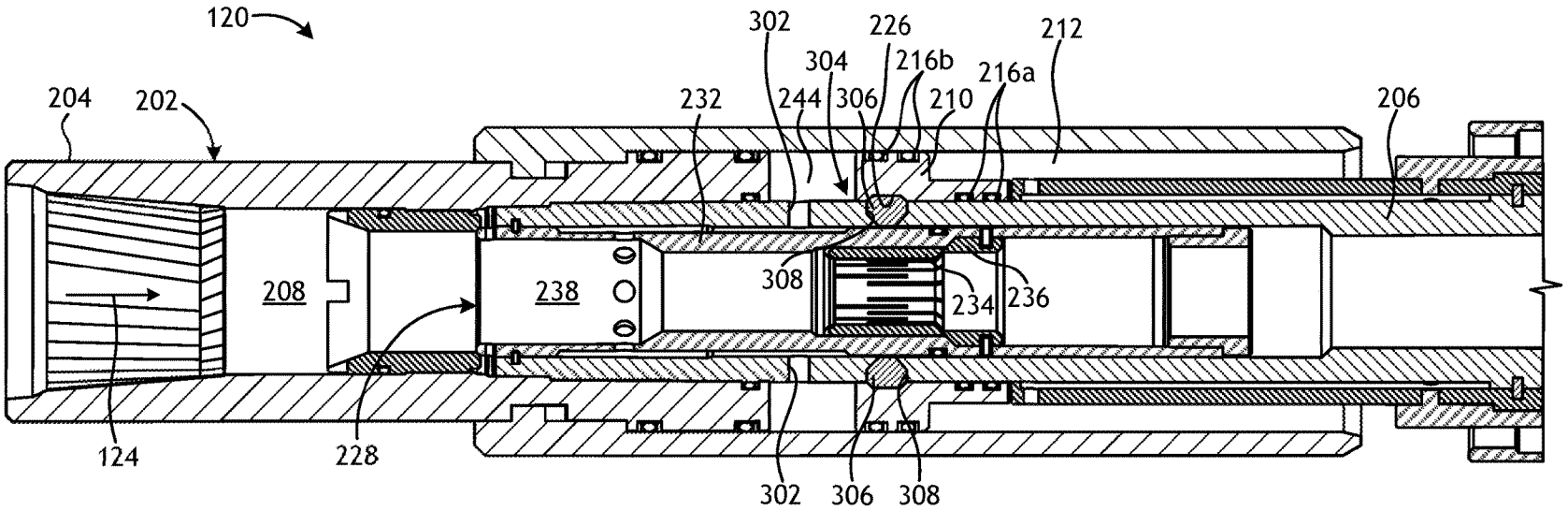
FIGS. 3A-3E are cross-sectional views of another example embodiment of the completion running tool of FIG. 1.

FIGS. 3A through 3E are cross-sectional views of another example embodiment of the completion running tool 120. Similar reference numerals used for the completion running tool 120 of FIGS. 2A-2E that are used in FIGS. 3A-3E correspond to like elements or components that may not be described again in detail. As illustrated in FIG. 3A, the completion running tool 120 may again include the body 202 that includes the outer and inner mandrels 204, 206 and defines the central flow passage 208. The piston 210 is arranged within the piston chamber 212 and sealed against leakage of pressurized fluid with the inner and outer seal elements 216*a,b*. The expendable seat assembly 228, including the prop sleeve 232, the expandable ring 234, and the shear collar 236, is again arranged within the central flow passage 208. Moreover, the apertures 242 defined in the prop sleeve 232 help facilitate fluid communication between the flow bore 238 (and the central flow passage 208) and the piston setting chamber 244.

Unlike the completion running tool 120 of FIGS. 2A-2E, however, fluids passing through the apertures 242 may access the piston setting chamber 244 via one or more radial flow ports 302 defined in the body 202 (i.e., the inner mandrel 206), where the radial flow ports 302 do not necessarily form part of a collet. Moreover, unlike the completion running tool 120 of FIGS. 2A-2E, the piston 210 of the completion running tool 120 shown in FIG. 3A may be removably coupled to the body 202 (i.e., the inner mandrel 206) at a releasable coupling 304 that is different than the releasable coupling 218 of FIGS. 2A-2E. More particularly, the releasable coupling 304 may include one or more lugs 306 (two shown) movably arranged within corresponding lug channels 308 defined in the body 202 (i.e., the inner mandrel 206). Each lug 306 may be configured to engage or otherwise be received by the piston profile 226 provided by the piston 210.

The prop sleeve 232 is movable within the central flow passage 208 between the first position (shown in FIGS. 3A-3B) and the second position (shown in FIGS. 3C-3E), and the prop sleeve 232 radially supports the releasable coupling 304 when in the first position. More specific to the illustrated embodiment, the lugs 306 may be radially supported by the prop sleeve 232 in the first position, which maintains the lugs 306 in coupled engagement with the piston profile 226. Until the lugs 306 disengage from the piston profile 226, the piston 210 will be unable to axially translate within the piston chamber 212. Upon moving the prop sleeve 232 to the second position, however, the lugs 306 will no longer be radially supported by the prop sleeve 232, which allows the lugs 306 to disengage from the piston profile 226.

Example operation of the completion running tool 120 is now provided with reference to FIGS. 3A-3E. In FIG. 3A, while the completion running tool 120 is conveyed downhole, the fluid 124 may be circulated through the work string 112 (FIG. 1) and into the central flow passage 208 of the completion running tool 120. As the fluid 124 circulates through the completion running tool 120, the fluid 124 accesses the piston setting chamber 244 via the apertures 242 defined in the prop sleeve 232 and the radial flow ports 302.

Figure 3B:
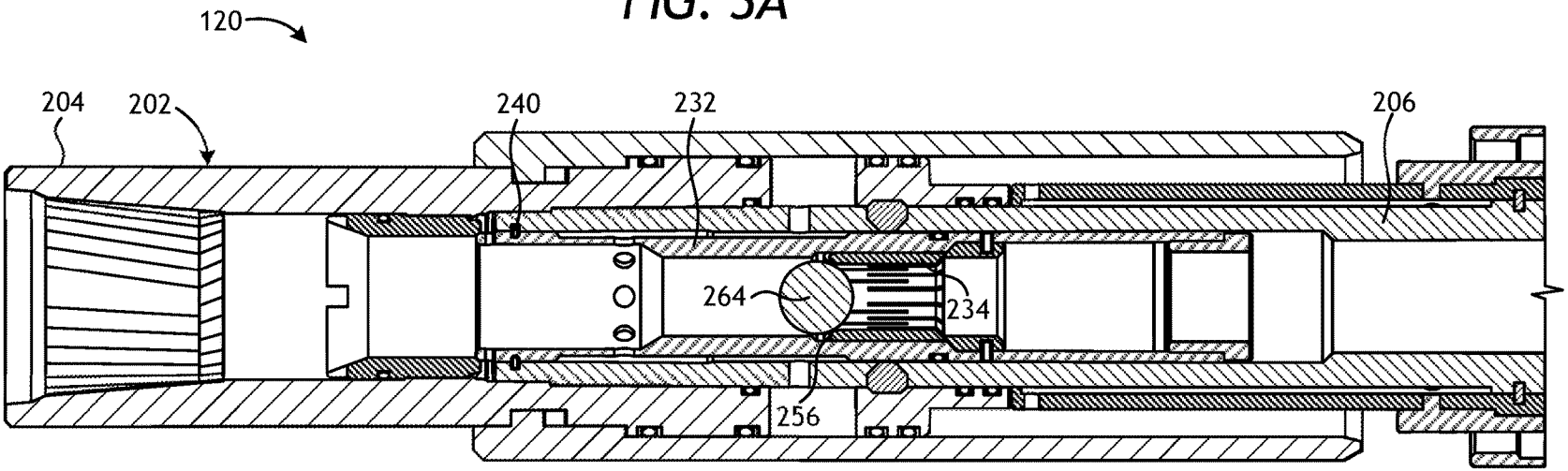

FIG. 3B shows the wellbore projectile 264 received within the completion running tool 120 by passing through the central flow passage 208 and the flow bore 238 and being received by the seat 256 provided on the uphole end of the expandable ring 234. With the wellbore projectile 264 sealingly engaged against the seat 256, the hydraulic pressure of the fluid 124 within the central flow passage 208 may be increased to disengage the prop sleeve 232 from the body 202 (i.e., the inner mandrel 206), as generally described above. The hydraulic pressure acting on the seat assembly 228 may then urge the seat assembly 228 to move in the downhole direction (i.e., to the right in FIG. 3B) from the first position to the second position.

Figure 3C:
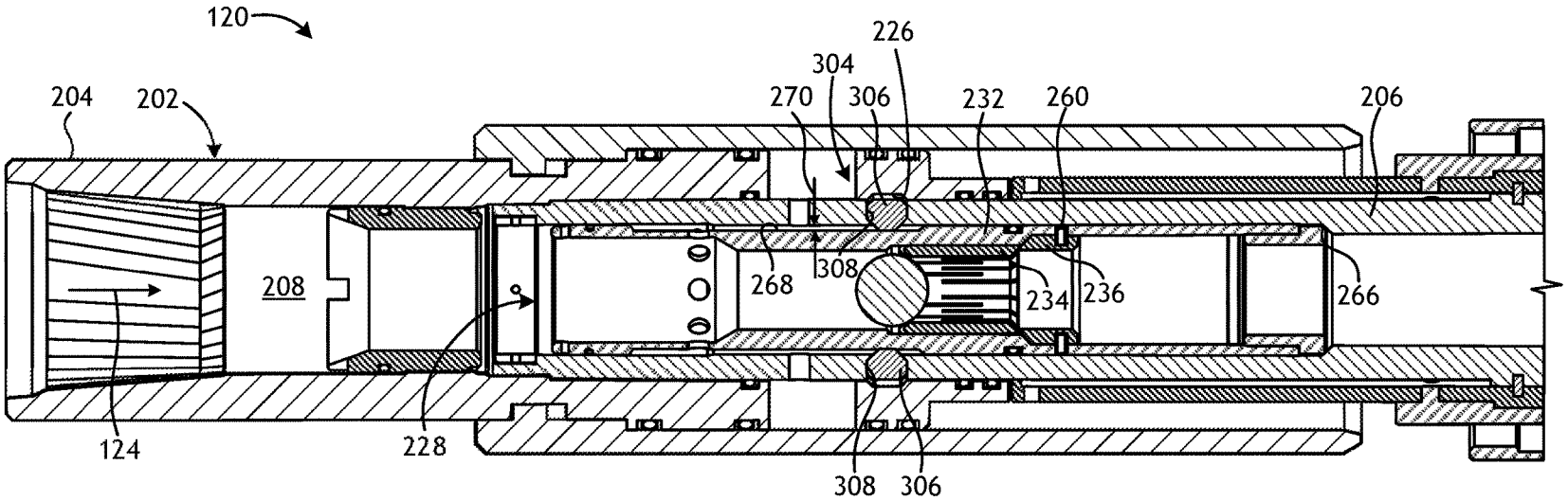

FIG. 3C shows the prop sleeve 232 moved axially within the central flow passage 208 to the second position and stopping once the distal end of the prop sleeve 232 engages the radial shoulder 266. In the second position, the prop sleeve 232 no longer radially supports the releasable coupling 304 and the lugs 306 may be able to disengage from the piston profile 226 by radially collapsing into the gap 270 formed by the reduced diameter portion 268 of the prop sleeve 232.

The expandable ring 234 may then be moved into the counterbore 254 to radially expand and release the wellbore projectile 264. As discussed above, this can be accomplished by increasing the pressure of the fluid 124 from the first pressure to the second pressure, which results in the lower shear member(s) 260 failing and freeing the shear collar 236 from the prop sleeve 232. The hydraulic pressure acting on the wellbore projectile 264 may then urge the expandable ring 234 and the shear collar 236 to move in the downhole direction (i.e., to the right in FIG. 3C), which moves the expandable ring 234 into the counterbore 254 and allows the expandable ring 234 to radially expand.

Figure 3D:
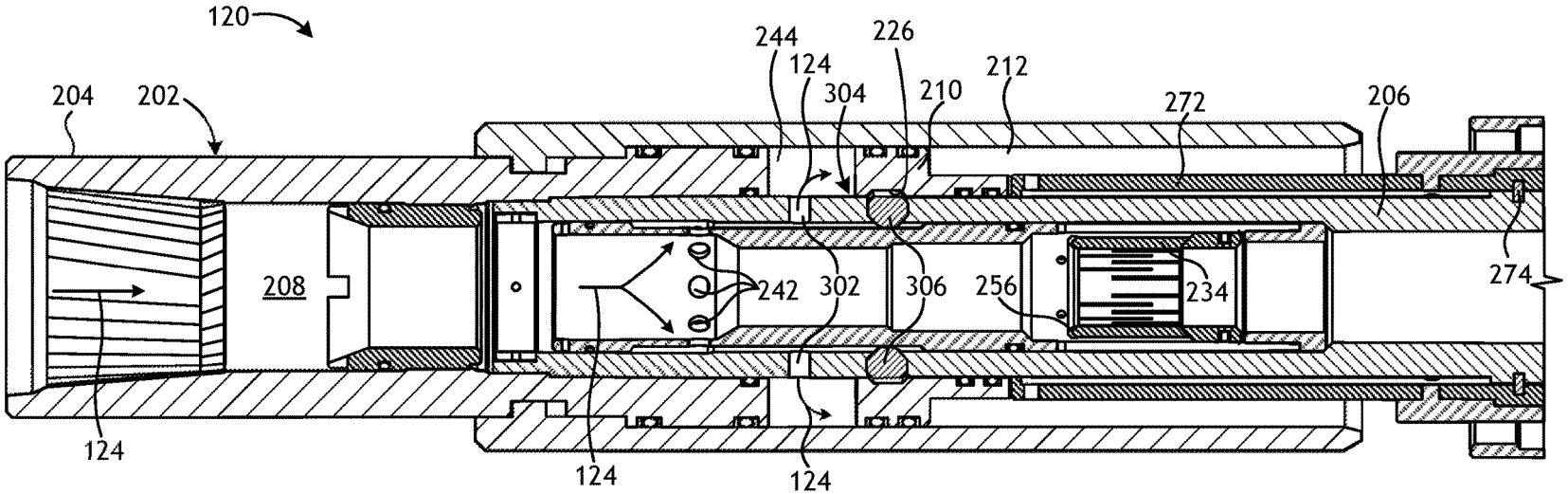

In FIG. 3D, the expandable ring 234 is shown as having shifted downhole into the counterbore 254 and having released the wellbore projectile 264 (FIGS. 3B-3C) from the seat 256 upon radial expansion. The hydraulic pressure of the fluid 124 within the central flow passage 208 may then be increased to act on the piston 210 and trigger actuation of the wellbore packer 122 (FIG. 1). More specifically, the fluid 124 may access the piston setting chamber 244 via the apertures 242 and the radial flow ports 302 to act on the piston 210. The hydraulic pressure of the fluid 124 places an axial load on the piston 210 that allows the lugs 306 to radially collapse and disengage from the piston profile 226. Moreover, the hydraulic pressure acting on the piston 210 urges the piston 210 axially against the packer setting arm 272 and serves to break (shear) the shear members 274 that couple the packer setting arm 272 to the body 202 (i.e., the inner mandrel 206). Once the shear members 274 are sheared, the piston 210 is free to move within the piston chamber 212 and able to move the packer setting arm 272 to actuate the wellbore packer 122.

Figure 3E:
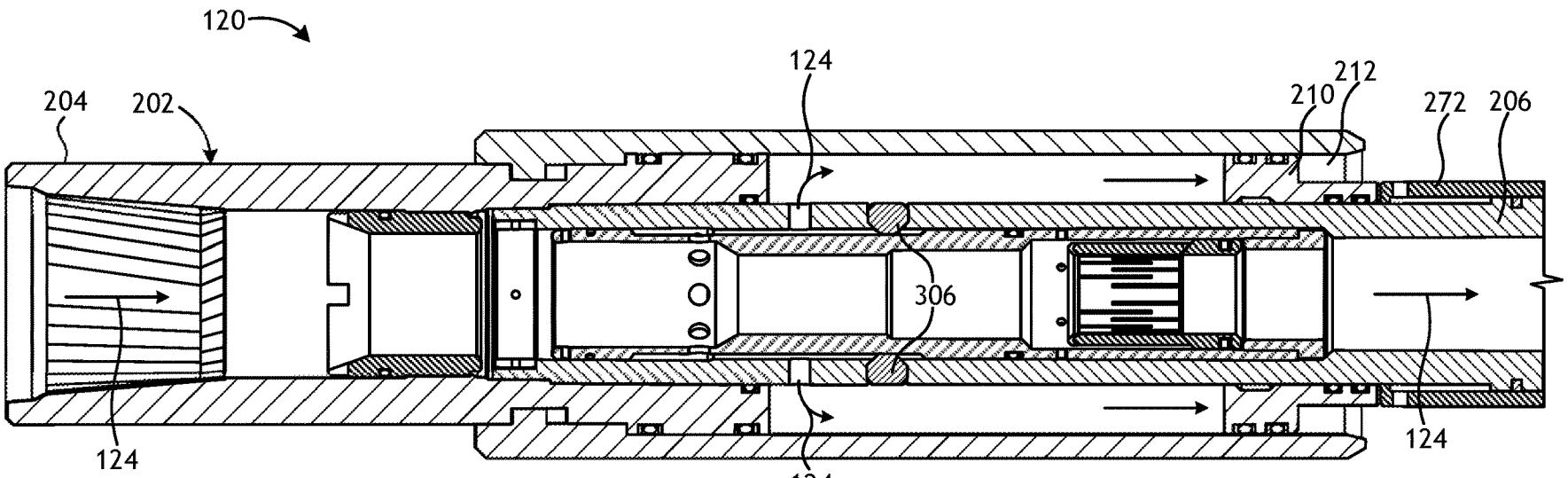

In FIG. 3E, the piston 210 is shown disengaged from the lugs 306 and moved downhole within the piston chamber 212. As the piston 210 moves under the hydraulic load provided by the fluid 124, the packer setting arm 272 correspondingly moves in the same direction to actuate the wellbore packer 122 (FIG. 1).

Embodiments disclosed herein include:

A. A completion running tool that includes a body that defines a central flow passage and one or more radial flow ports, a piston coupled to the body at a releasable coupling and positioned for longitudinal movement within a piston chamber defined radially between the body and an outer shroud, and a prop sleeve positioned in the central passage and defining one or more apertures that facilitate fluid communication between the central passage and a piston setting chamber via the one or more radial flow ports, wherein the prop sleeve is movable within the central flow passage between a first position, where the prop sleeve radially supports the releasable coupling and thereby prevents disengagement of the piston, and a second position, where the piston is able to disengage from the releasable coupling and move within the piston chamber.

B. A well system that includes a work string extendable within a wellbore, a completion assembly operatively coupled to a lower end of the work string and terminating at a float shoe, a completion running tool and a wellbore packer interposing the completion assembly and the work string, the completion running tool including a body coupled to the work string at a first end and coupled to the wellbore packer at a second end, the body defining a central flow passage in fluid communication with the work string and further defining one or more radial flow ports, a piston coupled to the body at a releasable coupling and positioned for longitudinal movement within a piston chamber defined radially between the body and an outer shroud, and a prop sleeve positioned in the central passage and defining one or more apertures that facilitate fluid communication between the central passage and a piston setting chamber via the one or more radial flow ports, wherein the prop sleeve is movable within the central flow passage between a first position, where the prop sleeve radially supports the releasable coupling and thereby prevents disengagement of the piston, and a second position, where the piston is able to disengage from the releasable coupling and move within the piston chamber.

C. A method that includes conveying a completion assembly into a wellbore, the completion assembly being operatively coupled to a work string with a completion running tool and a wellbore packer, wherein the completion running tool includes a body coupled to the work string at a first end and coupled to the wellbore packer at a second end, the body defining a central flow passage in fluid communication with the work string and further defining one or more radial flow ports, a piston coupled to the body at a releasable coupling and positioned for longitudinal movement within a piston chamber defined radially between the body and an outer shroud, and a prop sleeve positioned in the central passage and defining one or more apertures, the prop sleeve being movable between a first position, where the prop sleeve radially supports the releasable coupling and thereby prevents disengagement of the piston, and a second position, where the piston is able to disengage from the releasable coupling and move within the piston chamber. The method further including circulating a fluid through the central flow passage and into a piston setting chamber via the one or more apertures and the one or more radial flow ports while conveying the completion assembly into the wellbore, landing a wellbore projectile on a seat provided on an expandable ring positioned within the prop sleeve, increasing a fluid pressure of the fluid to a first pressure and thereby moving the prop sleeve to the second position, increasing the fluid pressure of the fluid to a second pressure and thereby disengaging the piston from the releasable coupling and moving the piston within the piston chamber, and actuating the wellbore packer as the piston moves within the piston chamber.

Each of embodiments A, B, and C may have one or more of the following additional elements in any combination: Element 1: wherein the releasable coupling comprises a collet providing at least one collet finger defined by the one or more flow ports, and a head provided on the at least one collet finger to engage a piston profile provided by the piston, wherein the at least one collet finger is radially supported by the prop sleeve in the first position and thereby maintains the head in coupled engagement with the piston profile. Element 2: wherein the releasable coupling comprises one or more lugs movably arranged within a corresponding one or more lug channels defined in the body, each lug being engageable with a piston profile provided by the piston, wherein the prop sleeve in the first position radially supports the one or more lugs and thereby maintains the one or more lugs in coupled engagement with the piston profile. Element 3: further comprising an expandable ring positioned within the prop sleeve and being movable between a radially contracted condition and a radially expanded condition, the expandable ring providing a seat that receives a wellbore projectile when in the radially contracted condition, and a shear collar positioned within and coupled to the prop sleeve axially adjacent the expandable ring. Element 4: wherein the prop sleeve is coupled to the body with one or more upper shear members and the shear collar is coupled to the prop sleeve with one or more lower shear members, and wherein a shear limit of the one or more lower shear members is greater than a shear limit of the one or more upper shear members.

Element 5: wherein the releasable coupling comprises a collet providing at least one collet finger defined by the one or more radial flow ports, and a head provided on the at least one collet finger to engage a piston profile provided by the piston, wherein the at least one collet finger is radially supported by the prop sleeve in the first position, which maintains the head in coupled engagement with the piston profile. Element 6: wherein the releasable coupling comprises one or more lugs movably arranged within a corresponding one or more lug channels defined in the body, each lug being engageable with a piston profile provided by the piston, wherein the prop sleeve in the first position radially supports the one or more lugs and thereby maintains the one or more lugs in coupled engagement with the piston profile. Element 7: further comprising a wellbore projectile conveyable into the completion running tool via the work string, an expandable ring positioned within the prop sleeve and providing a seat that receives the wellbore projectile, the expandable ring being movable between a radially contracted condition and a radially expanded condition, and a shear collar positioned within and coupled to the prop sleeve axially adjacent the expandable ring. Element 8: wherein the prop sleeve is coupled to the body with one or more upper shear members and the shear collar is coupled to the prop sleeve with one or more lower shear members, and wherein a shear limit of the one or more lower shear members is greater than a shear limit of the one or more upper shear members. Element 9: further comprising a packer setting arm positioned axially adjacent the piston and operatively coupled to the wellbore packer, wherein movement of the piston within the piston chamber correspondingly moves the packer setting arm and thereby actuates the wellbore packer.

Element 10: wherein a packer setting arm is positioned axially adjacent the piston and operatively coupled to the wellbore packer, and wherein actuating the wellbore packer as the piston moves within the piston chamber comprises engaging the packer setting arm with the piston and thereby moving the packer setting arm as the piston moves. Element 11: wherein the packer setting arm is coupled to the body with one or more shear members, increasing the fluid pressure of the fluid to the second pressure comprises increasing the fluid pressure of the fluid to a pressure sufficient to disengage the releasable coupling and shear the one or more shear members. Element 12: wherein the releasable coupling comprises a at least one collet finger defined by the one or more radial flow ports and a head provided on the at least one collet finger to engage a piston profile provided by the piston, and wherein disengaging the piston from the releasable coupling comprises placing an axial load on the piston with the fluid pressure at the second pressure, and disengaging the head from the piston profile. Element 13: wherein the releasable coupling comprises one or more lugs movably arranged within a corresponding one or more lug channels defined in the body, each lug being engageable with a piston profile provided by the piston, and wherein disengaging the piston from the releasable coupling comprises placing an axial load on the piston with the fluid pressure at the second pressure, and disengaging the one or more lugs from the piston profile. Element 14: wherein the prop sleeve is coupled to the body with one or more upper shear members and increasing the fluid pressure of the fluid within the central flow passage to the first pressure comprises shearing the one or more upper shear members. Element 15: wherein the completion running tool further includes a shear collar positioned within and coupled to the prop sleeve with one or more lower shear members, and wherein increasing the fluid pressure of the fluid within the central flow passage to the second pressure comprises placing an axial load on the expandable ring and the shear collar via the wellbore projectile, shearing the one or more lower shear members with the axial load, moving the expandable ring within the prop sleeve from a radially contracted condition to a radially expanded condition, and releasing the wellbore projectile from the seat with the expandable ring in the radially expanded condition. Element 16: wherein the completion assembly terminates at a float shoe and the method further comprises ejecting the fluid out of the completion assembly via the float shoe as the completion assembly is conveyed into the wellbore, and washing the wellbore with the fluid as the completion assembly is conveyed into the wellbore.

By way of non-limiting example, exemplary combinations applicable to A, B, and C include: Element 3 with Element 4; Element 7 with Element 8; Element 7 with Element 9; and Element 10 with Element 11.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A completion running tool, comprising:

a body that defines a central flow passage and one or more radial flow ports;

a piston coupled to the body at a releasable coupling and positioned for longitudinal movement within a piston chamber defined radially between the body and an outer shroud;

a prop sleeve positioned in the central flow passage and defining one or more apertures that facilitate fluid communication between the central flow passage and a piston setting chamber via the one or more radial flow ports; and a shear collar positioned within and coupled to the prop sleeve, wherein the prop sleeve is coupled to the body with one or more upper shear members and the shear collar is coupled to the prop sleeve with one or more lower shear members, wherein the prop sleeve is movable within the central flow passage between a first position, where the prop sleeve radially supports the releasable coupling and thereby prevents disengagement of the piston, and a second position, where the piston is able to disengage from the releasable coupling and move within the piston chamber.

2. The completion running tool of claim 1, wherein the releasable coupling comprises:

a collet providing at least one collet finger; and a head provided on the at least one collet finger to engage a piston profile provided by the piston, wherein the at least one collet finger is radially supported by the prop sleeve in the first position and thereby maintains the head in coupled engagement with the piston profile.

3. The completion running tool of claim 1, wherein the releasable coupling comprises:

one or more lugs movably arranged within a corresponding one or more lug channels defined in the body, each lug being engageable with a piston profile provided by the piston, wherein the prop sleeve in the first position radially supports the one or more lugs and thereby maintains the one or more lugs in coupled engagement with the piston profile.

4. The completion running tool of claim 1, further comprising:

an expandable ring positioned within the prop sleeve and being movable between a radially contracted condition and a radially expanded condition, the expandable ring providing a seat that receives a wellbore projectile when in the radially contracted condition.

5. The completion running tool of claim 4, wherein a shear limit of the one or more lower shear members is greater than a shear limit of the one or more upper shear members.

6. A well system, comprising:

a work string extendable within a wellbore;

a completion assembly operatively coupled to a lower end of the work string and terminating at a float shoe;

a completion running tool and a wellbore packer interposing the completion assembly and the work string, the completion running tool including:

a body coupled to the work string at a first end and coupled to the wellbore packer at a second end, the body defining a central flow passage in fluid communication with the work string and further defining one or more radial flow ports;

a piston coupled to the body at a releasable coupling and positioned for longitudinal movement within a piston chamber defined radially between the body and an outer shroud; and a prop sleeve positioned in the central flow passage and defining one or more apertures that facilitate fluid communication between the central flow passage and a piston setting chamber via the one or more radial flow ports; and a shear collar positioned within and coupled to the prop sleeve, wherein the prop sleeve is coupled to the body with one or more upper shear members and the shear collar is coupled to the prop sleeve with one or more lower shear members, wherein the prop sleeve is movable within the central flow passage between a first position, where the prop sleeve radially supports the releasable coupling and thereby prevents disengagement of the piston, and a second position, where the piston is able to disengage from the releasable coupling and move within the piston chamber.

7. The well system of claim 6, wherein the releasable coupling comprises:

a collet providing at least one collet finger; and a head provided on the at least one collet finger to engage a piston profile provided by the piston, wherein the at least one collet finger is radially supported by the prop sleeve in the first position, which maintains the head in coupled engagement with the piston profile.

8. The well system of claim 6, wherein the releasable coupling comprises:

one or more lugs movably arranged within a corresponding one or more lug channels defined in the body, each lug being engageable with a piston profile provided by the piston, wherein the prop sleeve in the first position radially supports the one or more lugs and thereby maintains the one or more lugs in coupled engagement with the piston profile.

9. The well system of claim 6, further comprising:

a wellbore projectile conveyable into the completion running tool via the work string;

an expandable ring positioned within the prop sleeve and providing a seat that receives the wellbore projectile, the expandable ring being movable between a radially contracted condition and a radially expanded condition.

10. The well system of claim 9, wherein a shear limit of the one or more lower shear members is greater than a shear limit of the one or more upper shear members.

11. The well system of claim 9, further comprising a packer setting arm positioned axially adjacent the piston and operatively coupled to the wellbore packer, wherein movement of the piston within the piston chamber correspondingly moves the packer setting arm and thereby actuates the wellbore packer.

12. A method, comprising:

conveying a completion assembly into a wellbore, the completion assembly being operatively coupled to a work string with a completion running tool and a wellbore packer, wherein the completion running tool includes:

a body coupled to the work string at a first end and coupled to the wellbore packer at a second end, the body defining a central flow passage in fluid communication with the work string and further defining one or more radial flow ports;

a piston coupled to the body at a releasable coupling and positioned for longitudinal movement within a piston chamber defined radially between the body and an outer shroud; and a prop sleeve positioned in the central flow passage and defining one or more apertures, the prop sleeve being movable between a first position, where the prop sleeve radially supports the releasable coupling and thereby prevents disengagement of the piston, and a second position, where the piston is able to disengage from the releasable coupling and move within the piston chamber;

circulating a fluid through the central flow passage and into a piston setting chamber via the one or more apertures and the one or more radial flow ports while conveying the completion assembly into the wellbore;

landing a wellbore projectile on a seat provided on an expandable ring positioned within the prop sleeve;

increasing a fluid pressure of the fluid to a first pressure and thereby moving the prop sleeve to the second position;

increasing the fluid pressure of the fluid to a second pressure and thereby disengaging the piston from the releasable coupling and moving the piston within the piston chamber; and actuating the wellbore packer as the piston moves within the piston chamber, wherein a packer setting arm is positioned axially adjacent the piston and operatively coupled to the wellbore packer, and wherein actuating the wellbore packer as the piston moves within the piston chamber comprises engaging the packer setting arm with the piston and thereby moving the packer setting arm as the piston moves.

13. The method of claim 12, wherein the packer setting arm is coupled to the body with one or more shear members, increasing the fluid pressure of the fluid to the second pressure comprises increasing the fluid pressure of the fluid to a pressure sufficient to disengage the releasable coupling and shear the one or more shear members.

14. The method of claim 12, wherein the releasable coupling comprises a at least one collet finger and a head provided on the at least one collet finger to engage a piston profile provided by the piston, and wherein disengaging the piston from the releasable coupling comprises:

placing an axial load on the piston with the fluid pressure at the second pressure; and disengaging the head from the piston profile.

15. The method of claim 12, wherein the releasable coupling comprises one or more lugs movably arranged within a corresponding one or more lug channels defined in the body, each lug being engageable with a piston profile provided by the piston, and wherein disengaging the piston from the releasable coupling comprises:

placing an axial load on the piston with the fluid pressure at the second pressure; and disengaging the one or more lugs from the piston profile.

16. The method of claim 12, wherein the prop sleeve is coupled to the body with one or more upper shear members and increasing the fluid pressure of the fluid within the central flow passage to the first pressure comprises shearing the one or more upper shear members.

17. The method of claim 12, wherein the completion running tool further includes a shear collar positioned within and coupled to the prop sleeve with one or more lower shear members, and wherein increasing the fluid pressure of the fluid within the central flow passage to the second pressure comprises:

placing an axial load on the expandable ring and the shear collar via the wellbore projectile;

shearing the one or more lower shear members with the axial load;

moving the expandable ring within the prop sleeve from a radially contracted condition to a radially expanded condition; and releasing the wellbore projectile from the seat with the expandable ring in the radially expanded condition.

18. The method of claim 12, wherein the completion assembly terminates at a float shoe and the method further comprises:

ejecting the fluid out of the completion assembly via the float shoe as the completion assembly is conveyed into the wellbore; and washing the wellbore with the fluid as the completion assembly is conveyed into the wellbore.

* * * * *